United States Patent [19]

Dronet

[11] Patent Number: 4,470,514

[45] Date of Patent: Sep. 11, 1984

[54] CONTAINER HAVING FRANGIBLE OPENING MEANS

[75] Inventor: Jean-Marc Dronet, Falaise, France

[73] Assignee: Plastimecanique S.A., Falaise, France

[21] Appl. No.: 484,922

[22] Filed: Apr. 14, 1983

[30] Foreign Application Priority Data

Apr. 14, 1982 [DE] Fed. Rep. of Germany ..... 3213653

[51] Int. Cl.[3] ..... B65D 17/40

[52] U.S. Cl. ..... 220/276

[58] Field of Search ..... 220/270, 266, 276, 359; 229/43

[56] References Cited

U.S. PATENT DOCUMENTS 3,276,616 10/1966 Lurie ..... 220/276

4,212,409 7/1980 Jeppsson ..... 220/270

*Primary Examiner*—George T. Hall

[57] ABSTRACT

The invention relates to a container for food substances, in particular for small portions of a drinkable food substance. Such container has an upper outwardly radially extending edge portion on which a foil is sealingly affixed thereby sealing the food substance within the container. Moreover, the container has affixed thereto a banderole strip for providing a hygienic condition for a person consuming the food substance. The undersurface of the radially outwardly projecting edge portion of the container is provided with a structurally weakened zone, preferably in the form of an annular groove. By bending this outer edge portion upwardly it is sheared off the container in the structurally weakened zone and thereby presents a hygienically flaw-free drinking edge. Additionally, the outer peripheral surface of the container 10 can be exposed by severing a partial banderole strip from the banderole, which partial banderole strip is immediately adjacent to the radially outwardly extending edge portion. The partial banderole strip is severable from the remainder of the banderole strip by providing a circumferential perforation line along the banderole strip. The partial banderole strip of the banderole protects the outer wall surface of the container during transport and storage until the contents of the container are being consumed.

5 Claims, 2 Drawing Figures

CONTAINER HAVING FRANGIBLE OPENING MEANS

BACKGROUND OF THE INVENTION

The invention relates to a container for food substances in particular for small portions of a drinkable food substance. The invention relates to a container having a projecting edge portion which extend parallel to the bottom of the container in a radial direction outwardly. A foil is sealed to this edge and projects the food substance during storage and transporting thereof. Moreover, the outer peripheral surface of the container has at least one banderole affixed thereto.

The afore-described type of container has a relatively small content, for example ⅛ l of a drinkable liquid food substance which is frequently used in schools, kindergarten or by athletes, who wish to consume the contained food substance by imbibing it and require no further careful storing of the opened container after the one-time use.

One problem that has been encountered in practice with the afore-described type of containers, to wit the maintenance of hygienic conditions during consuming of the food substance, while simultaneously maintaining an easy dispensing of the packaged food substance, in particular then, when such containers are to be opened by children.

There are already known containers of the afore-described type, which have a foil that is sealed to the projected edge portion of the container and which can be easily pulled off. However, these containers do not provide a hygienic condition as the food substance content of the container is consumed, for example a drink, because the edge portion, which can become soiled during transport or storage, must be contacted during the consuming of the food substance by being placed against the lips.

SUMMARY OF THE INVENTION

It is object of this invention to provide a container for food substances, in particular for small portions of a drinkable food substance, which is hygienically maintained during storage and transport and in addition to that maintains hygienic conditions during consuming of the food substance, without requiring any additional auxiliary means, such for example as a drinking straw or the like.

BRIEF DESCRIPTION OF THE DRAWING

Further objects and advantages of the invention will be apparent from the following description of typical embodiments, in preferred form, taken in connection with the attached drawings, in which.

DETAILED DESCRIPTION OF THE INVENTION

Figure 1:
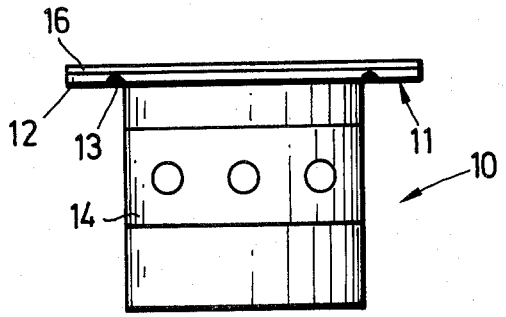
FIG. 1 is a schematic side-elevational view of a container in accordance with this invention.
Figure 2:
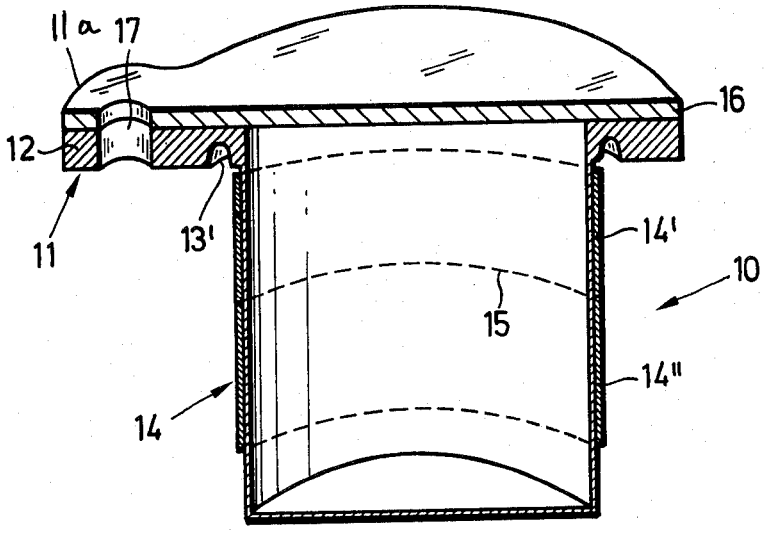
FIG. 2 illustrates the container of FIG. 1 in perspective as well as cross-sectionally.

The container 10 according to FIG. 1 includes an edge portion extending radially outwardly, which serves as a support for a foil 16 which is affixed to the edge portion during transport and storage thereby sealing the container 10. At the underside 11 of the edge portion 12 of the container 10 there is disposed a structurally weakened zone, which is preferably in the form of an annular goove 13' (FIG. 2). This structurally weakened zone 13, 13' makes it possible to easily open the container 10, in which the radially extending edge portion 12 together with the thereon affixed foil 16 can be bent upwardly, that is away from the container bottom. During this bending motion the edge portion 12 of the container 10 is torn in the region of the structurally weakened zone 13, 13' and is detached in the form of an annularly shaped strip which is still covered by the foil 16 to thereby expose the contents of the container 10. It has been surprisingly ascertained that all the conventional synthetic material which are used for packaging surfaces afford during this tearing (opening) process a completely flaw-free drinking edge which has no sharp ridge. Thereby the easy consuming of the food substance is possible from such an opened container by placing the container's upper edge against the lips of the person consuming the contents of the container. Since this drinking edge is only formed during the shearing off process of the edge portion 12, a soiling of such a drinking edge or any other kind of contamination during storage or during transport of the container 10 has been eliminated. Therefore, a hygienically flaw-free condition is attained during consuming of the food substance.

Frequently the exterior wall of the container 10 is provided with a banderole, which has printed matter of different types affixed thereon, for example for advertising purposes. The banderole consists in many cases of a paper or synthetic material strip, which strip is affixed to the outer surface of the container 10 by heat-sealing it or glueing it thereto. In an advantageous embodiment of this invention the banderole 14 is directly pulled up underneath the edge portion 12 of the container 10 and preferably separated by means of an annular perforation 15 into two easily separable partial banderole strips 14' and 14". Only the lower partial banderole strip 14" of the banderole 15 is advantageously affixed by means of a large surface area glueing to the outer surface of the container 10, whereas the upper partial banderole strip 14' is losely resting on the outer surface of the container 10. After severing the projecting edge portion 12 for initiating the drinking process the upper partial banderole strip 14' is severed along the annular perforation 15. In this manner there is provided for the consumer a relatively clean upper edge of the container 10 for the drinking process since this upper outer wall portion of the container 10 is protected during the transport and storage by means of the severable partial banderole strip 14'.

In a further embodiment of this invention the upper partial banderole strip 14' of the banderole 14 can be severed along the perforation line 15. However, the partial banderole strip 14' is spot-glued onto the exterior peripheral surface of the container 10. Also in this embodiment an easy separation or severing of at least the upper partial banderole strip 14' for readying the drinking process is possible.

A gripping surface which facilitates the opening of the container 10 is provided by a portion of the edge portion 12 which is asymmetrically shaped and which is located at predetermined distances along the edge portion whereby radially outer projecting portions **11*a* are provided which are also covered by the foil 16, portions 11*a* also include through bores 17**.

Although the invention is described and illustrated with reference to a plurality of embodiments thereof, it is to be expressly understood that it is in no way limited to the disclosure of such preferred embodiments but is capable of numerous modifications within the scope of the appended claims.

I claim:

1. An improved container for food substances, in particular for small portions of drinkable food substances, which container has a bottom and a radially outwardly extending upper edge portion which lies in a plane parallel to said bottom, and includes a foil sealingly affixed to said upper edge portion and a banderole strip affixed to the outer wall surface of said container, the improvement comprising said radially outwardly extending upper edge portion having a structurally weakened zone in the form of an annular groove extending along the underside thereof.

2. The improvement in a container, as set forth in claim 1, wherein said banderole strip has been pulled upwardly prior to being affixed to the outer wall surface of said container so that its upper edge adjoins the underside of said upper edge portion, at least a portion of said banderole strip being severable from the remainder so as to expose at least a portion of the outer wall surface of the container which adjoins the underside of the edge portion.

3. The improvement in a container, as set forth in claim 2, including a line of perforations extending along said banderole strip, said line of perforations dividing said banderole into an upper strip and a lower strip; only said upper strip being severable from said lower strip and said container, and only said lower strip being affixed to the outer wall surface of said container by heat sealing or glueing.

4. The improvement in a container, as set forth in claim 2, including a line of perforations extending along said banderole strip, said line of perforations dividing said banderole into an upper strip and a lower strip; only said upper strip being severable from said lower strip, said upper strip being spotglued to the outer wall surface of said container so as to be severable therefrom, and only said lower strip being affixed to the outer wall surface of said container by heat sealing or glueing.

5. The improvement in a container, as set forth in claim 4, wherein said radially outwardly extending edge portion includes at least one outwardly radially extending asymmetrical portion which forms a gripping surface adapted to be manually gripped for purposes of tearing said foil and edge portion from said container; said asymmetrical portion having a bore extending therethrough.

* * * * *